US006739731B2

(12) United States Patent
Katzman

(10) Patent No.: US 6,739,731 B2
(45) Date of Patent: May 25, 2004

(54) CONTAINER FOR A POTABLE LIQUID

(76) Inventor: David W. Katzman, 2923 Windwood Ct., Commerce Township, MI (US) 48382-1470

( * ) Notice: Subject to any disclaimer, the term of this patent is extended or adjusted under 35 U.S.C. 154(b) by 0 days.

(21) Appl. No.: 10/132,486

(22) Filed: Apr. 25, 2002

(65) Prior Publication Data

US 2002/0159247 A1 Oct. 31, 2002

Related U.S. Application Data

(60) Provisional application No. 60/287,118, filed on Apr. 27, 2001, and provisional application No. 60/298,312, filed on Jun. 14, 2001.

(51) Int. Cl.[7] ..... F21V 33/00

(52) U.S. Cl. ..... 362/101; 362/34; 206/219; 215/DIG. 8

(58) Field of Search ..... 362/34, 101; 206/219, 206/221, 568; 215/DIG. 8

(56) References Cited

U.S. PATENT DOCUMENTS 3,584,211 A * 6/1971 Rauhut ..... 362/34
3,856,138 A * 12/1974 Maekawa et al. ..... 206/221
4,563,726 A * 1/1986 Newcomb et al. ..... 362/34
4,784,678 A * 11/1988 Rudick et al. ..... 62/4
6,036,004 A * 3/2000 Bowen ..... 206/219
6,082,866 A * 7/2000 Amedee ..... 362/34
6,517,878 B2 * 2/2003 Heczko ..... 426/112

* cited by examiner

*Primary Examiner*—Sandra O'Shea
*Assistant Examiner*—Sharon Payne
(74) *Attorney, Agent, or Firm*—Gifford, Krass, Groh, Sprinkle, Anderson & Citkowski, PC

(57) ABSTRACT

A container for a potable liquid is disclosed having a self-contained illumination and/or cooling mechanism. With respect to the illumination, a mark, logo or other symbol is visible exteriorly of the container and this logo, mark or other symbol is formed from a chemical luminescence material which, upon activation, luminesceses or glows. The container also optionally contains a cartridge containing chemicals which, when intermixed, result in an endothermic reaction. These chemicals are normally separated from each other by a membrane which, upon rupture of the membrane and insertion of the cartridge into the container, cools the contents of the container.

1 Claim, 4 Drawing Sheets

CONTAINER FOR A POTABLE LIQUID

RELATED APPLICATION

This application claims priority of U.S. Provisional Patent Application No. 60/287,118 filed Apr. 27, 2001 and U.S. Provisional Patent Application No. 60/298,312 filed Jun. 14, 2001, which is incorporated herein by reference.

BACKGROUND OF THE INVENTION

I. Field of the Invention

The present invention relates generally to containers for potable liquids with a self-contained illumination and/or cooling means.

II. Description of the Prior Art

Containers for potable liquids are frequently made from plastic material. Such potable liquids include soft drinks, water, juices and the like. A cap is selectively removed from the potable container which permits consumption of the potable liquid by the user.

Many of the previously known containers include logos, symbols or trademarks which are imprinted or otherwise attached to the container. These previously known trademarks, however, are simply printed upon the labels. Although marketing personnel attempt to make the trademark as prominent as possible, the previously known practice of simply printing the trademark onto a label and then attaching the label to the potable liquid container inherently minimizes the visual impact of the trademark.

Additionally, in many cases, it is desired to chill the potable liquid prior to its consumption. In order to do this, it has been the previously known practice to place the container inside a refrigerator and left for a period of time. Furthermore, upon removal of the container from the refrigerator, the potable liquid must be consumed relatively rapidly before the liquid becomes warm by absorbing heat from the environment.

Alternatively, the potable liquid may be placed within an ice chest or similar structure in lieu of a refrigerator. Such ice chests are inherently more portable than refrigerators and do not require a power source for their operation. Disadvantageously, however, ice chests are bulky and heavy to transport. Furthermore, although ice chests may be used over an extended period, ice chests are unable to maintain the containers containing potable liquids in a chilled condition for an extended period of time.

The present invention provides a container for a potable liquid which overcomes all of the above-mentioned disadvantages of the previously known devices.

In brief, the device of the present invention provides a container for a potable liquid in which the trademark attached to the container comprises a chemical luminescent material. Such materials, when activated, emit visible light radiation for a period of time. Typically, such luminescence lasts for 20 or 30 minutes and thus for a period more than sufficient for consumption of the entire contents of the container by the user.

The trademark containing the luminescent material may be contained either within the interior of the container, assuming that the container is transparent, or on the outside surface of the container. The container itself is preferably made of a plastic material.

The luminescent material is preferably a two-part material which, when intermixed, luminesces. A membrane separates the luminescent parts from each other until ruptured by the user. At that time, the materials intermix thus causing the trademark to emit visible light radiation.

Optionally or alternatively, the container also includes a cavity formed in the bottom of the container and this cavity is preferably cylindrical in shape. The container itself is preferably made from plastic material although other materials may alternatively be used.

A cylindrical cartridge is dimensioned so that it is selectively insertable into the cavity in the container by the user. This cartridge contains two liquids which are separated by each other from a rupturable membrane. Furthermore, when these liquids intermix, an endothermic reaction results thus cooling the cartridge and the contents of the container, i.e. the potable liquid.

Thus, unlike the previously known refrigerators and ice chests, the potable liquid may be cooled immediately prior to consumption by self-contained means. Specifically, in use, the cartridge is removed from the container, the membrane ruptured thus intermixing the two liquids and the cartridge is then reinserted into the container. Thence, the container and its cooling means are entirely self-contained, external means to cool the contents of the container are rendered unnecessary.

BRIEF DESCRIPTION OF THE DRAWING

A better understanding of the present invention will be had upon reference to the following detailed description, when read in conjunction with the accompanying drawing, wherein like references refer to like parts throughout the several views, in which.

DETAILED DESCRIPTION OF THE PREFERRED EMBODIMENTS OF THE PRESENT INVENTION

Figure 1:
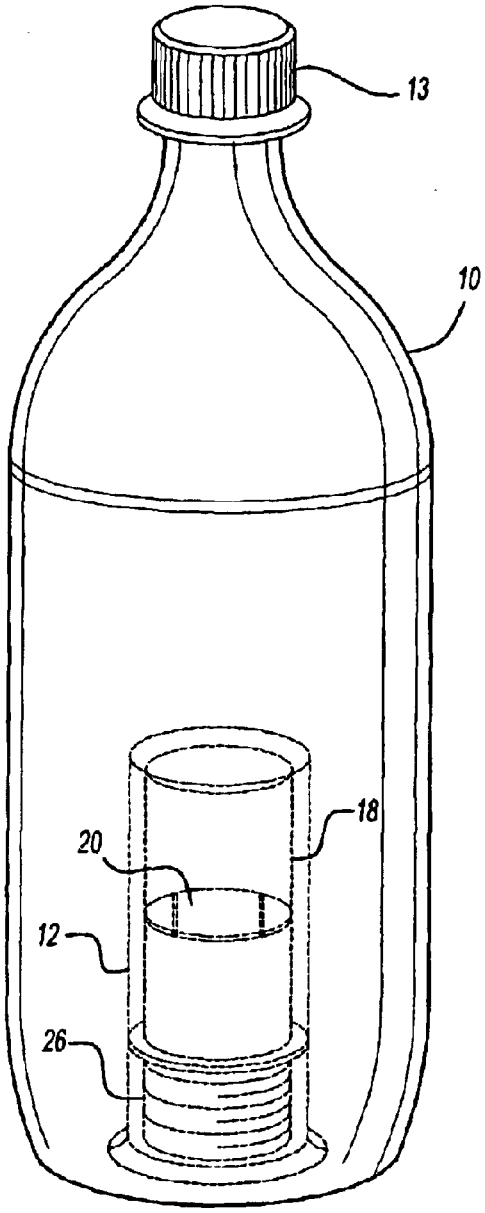
FIG. 1 is a side view illustrating a preferred embodiment of the present invention.

With reference first to FIG. 1, a first preferred embodiment of the container assembly of the present invention is there shown as a soft drink container 10 constructed of plastic. A cap 12 selectively closes one end of the container so that, upon opening of the cap 12, a potable liquid contained within the interior of the container may be consumed.

The container 10 is preferably constructed of a plastic material, includes an elongated and generally cylindrical cavity 12 extending longitudinally through the container 10. This cavity 12, furthermore, is open to the bottom 14 of the container 10. Furthermore, preferably the cavity 12 includes a threaded portion 16 adjacent the bottom 14 of the container 10.

Figure 2:
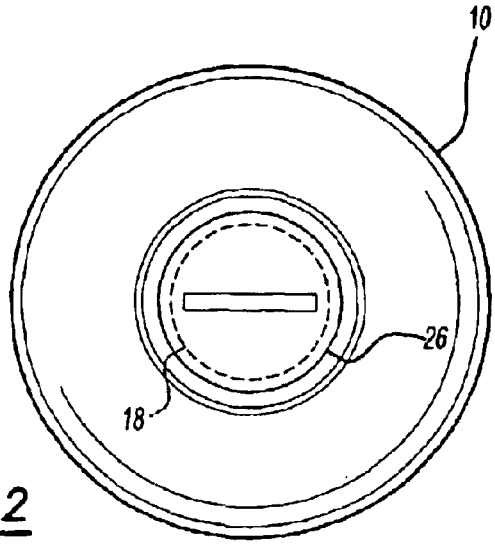
FIG. 2 is a bottom view of the preferred embodiment of the invention.
Figure 3:
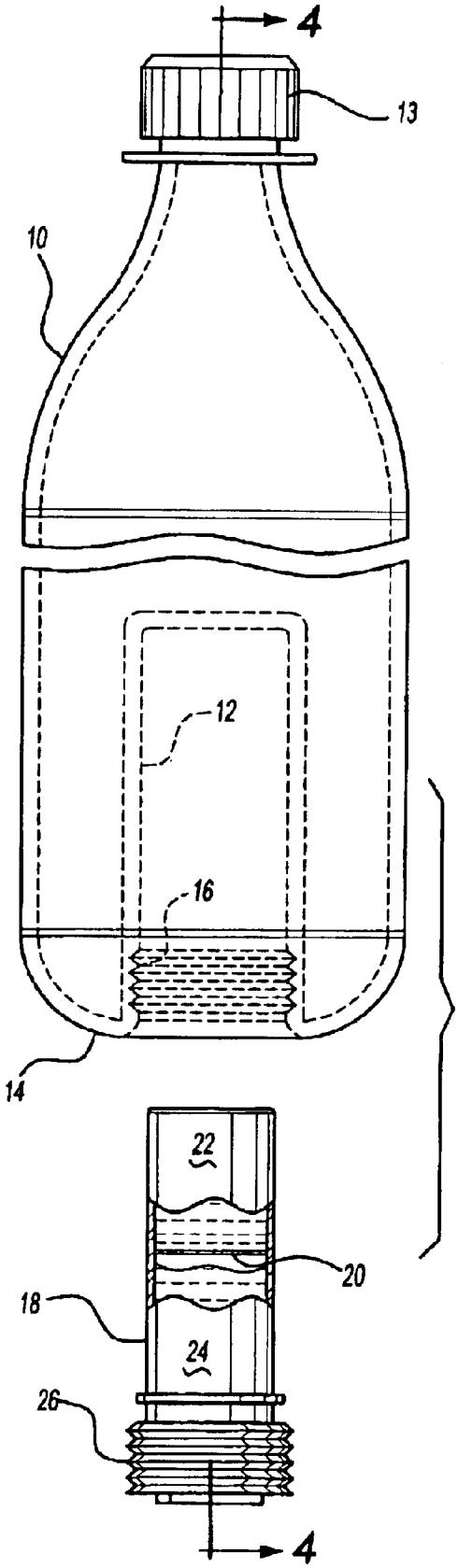
FIG. 3 is an exploded side view illustrating the preferred embodiment of the present invention.

As best shown in FIGS. 2 and 3, an elongated cylindrical cartridge 18 includes a frangible membrane 20 disposed along its length. This membrane 20 divides the cartridge 18 into two chambers 22 and 24. The chambers 22 and 24 are filled with liquids which, when intermixed, result in an endothermic reaction thus cooling the cartridge 18 as well as the contents of the container 10.

The cartridge 18 is dimensioned to be received within the cavity 12 of the container 10. Furthermore, the cartridge 18 includes a threaded portion 26 which threadably cooperates with the threaded portion 16 on the container 10 to secure the cartridge 18 to the container 10.

Figure 4:
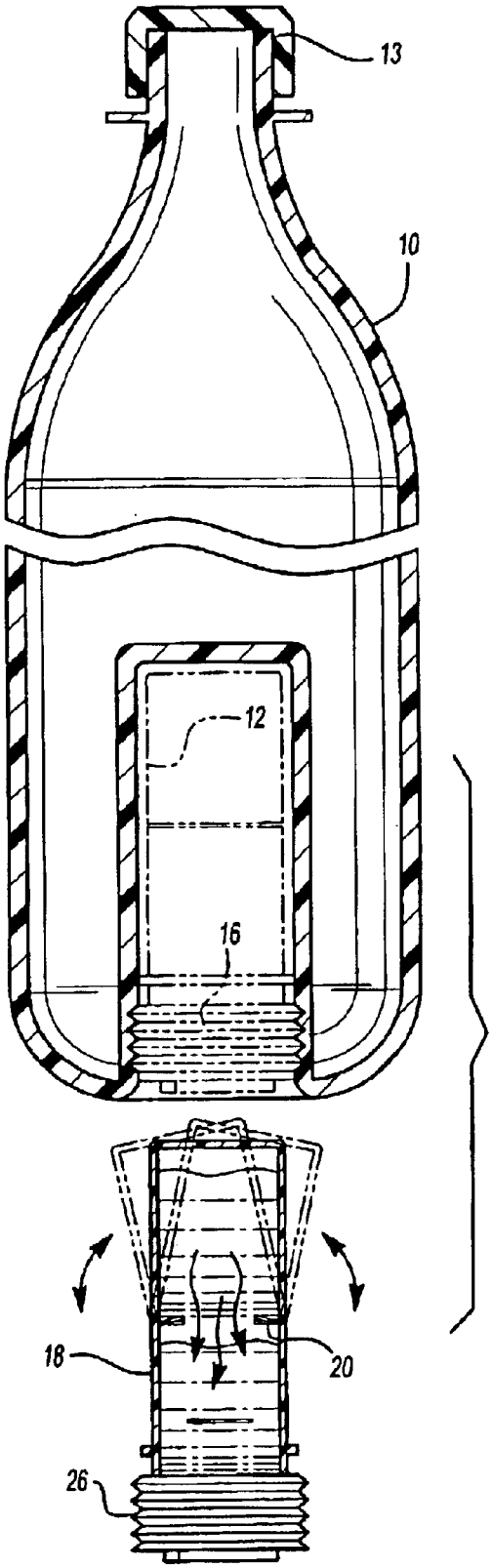
FIG. 4 is an exploded longitudinal sectional view illustrating the preferred embodiment of the present invention.

As best shown in FIG. 4, with the cartridge 18 removed from the container 10, the frangible membrane 20 is fractured by squeezing, bending or otherwise manipulating the cartridge 18 Upon rupture of the membrane 20, the liquid contained within the two chambers 22 and 24 intermix with each other. In doing so, an endothermic reaction results thus cooling the cartridge 18.

The cartridge 18 is then inserted into the cylindrical cavity 12 on the container 10 as shown in FIG. 1 and secured in place by screwing the cartridge 18 into the container so that the container threads 26 mesh with the container threads 16. The continuing endothermic reaction thus continues to cool the contents of the potable liquid container 10 in the desired fashion.

Figure 5:
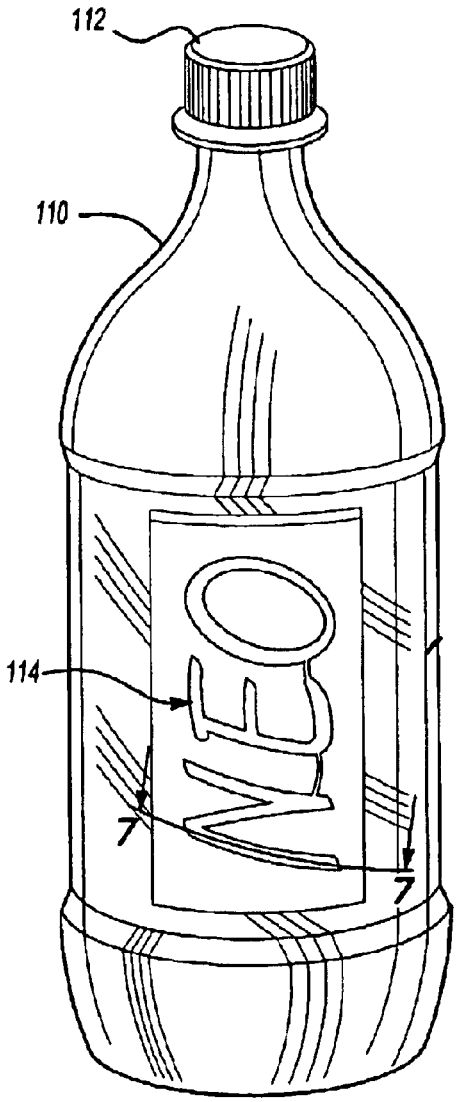
FIG. 5 is a plan view illustrating a second embodiment of the present invention.
Figure 7:
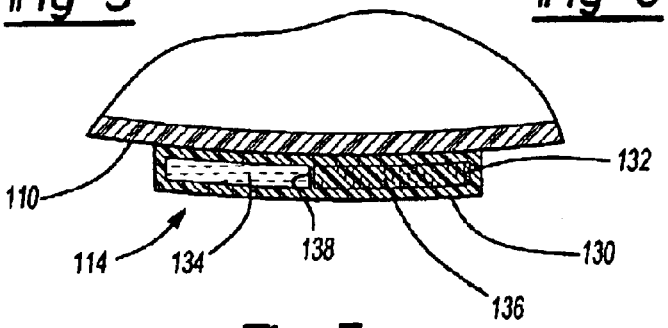
FIG. 7 is a fragmentary sectional view taken substantially along line 7—7 in FIG. 5.

With reference now to FIGS. 5 and 7, a second preferred embodiment of the container assembly of the present invention is shown comprising a container 110. The container 110 is of the type for containing a potable liquid, such as a soft drink. A cap 112 selectively provides access to the contents of the container 110.

A trademark assembly 114, illustrated in FIG. 5 as "NEO," is attached to the exterior of the container 110. Unlike the previously known trademarks, however, the trademark assembly 114 is constructed from a chemical luminescent material which, when activated, emits light radiation for a period of time, typically an hour or so. As such, the illumination of the luminescent material continues for a period more than sufficient to consume the potable liquid contained within the container 110.

Different mechanisms may be employed to activate the luminescent material. With reference to FIG. 7, however, one preferred method is there shown in which a trademark assembly 114 is formed by an elongated tube 130 having an interior chamber 132. This interior chamber 132, furthermore, is divided into two sub-chambers 134 and 136 by a frangible membrane 138.

The luminescent material contained within the trademark assembly 114, is a two-part material wherein one of the parts is contained within the sub-chamber 132 while the second part is contained within the sub-chamber 134. In order to intermix the two parts of the luminescent material together, the membrane 138 is ruptured, e.g. by squeezing the container 110, thus allowing the luminescent materials to intermix. Once the luminescent materials intermix, they emit visible light radiation, thus effectively illuminating the trademark 114 in the desired fashion.

Figure 6:
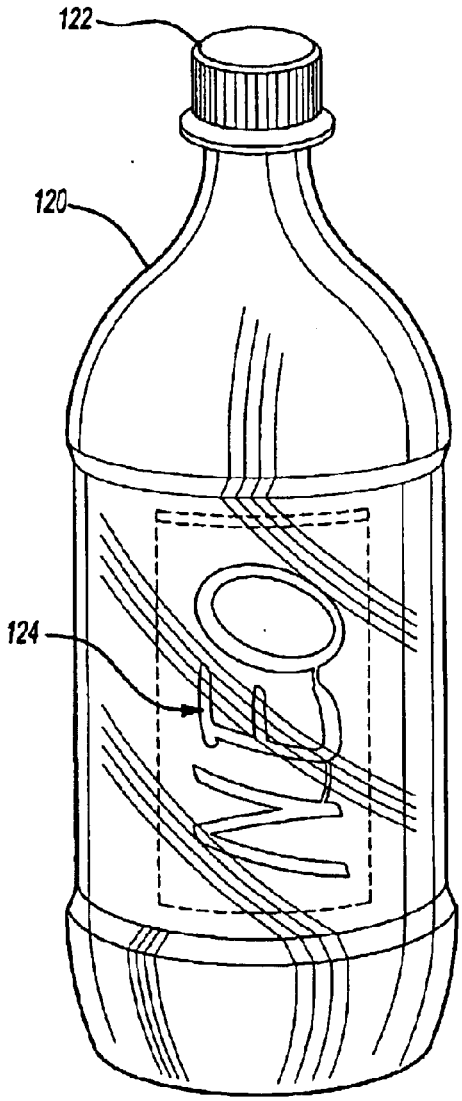
FIG. 6 is a plan view illustrating a third embodiment of the present invention.

With reference now to FIG. 6, a still further preferred embodiment of the container assembly of the invention is shown which, like the first embodiment, includes a container 120 which is made of a transparent material, such as transparent plastic. The container 120, like the container 110 in FIG. 5, also includes a cap 122 which, upon removal, allows the contents 120 of the container to be consumed.

Unlike the embodiment of the invention illustrated in FIG. 5, in FIG. 6 9 trademark assembly 124, also illustrated as "NEO," is contained within the interior of the container rather than on the outer periphery of the container. The trademark assembly 124, like the trademark assembly 114, is made from a chemical luminescent material which, when activated, emits visible light radiation. Since the container 120 is transparent, the trademark assembly 124 is visible, after activation, through the container 120.

Like the first preferred embodiment of the invention, the trademark 134 preferably comprises an elongated chamber divided into two parts by a frangible membrane. In the fashion previously described, upon rupture of the frangible membrane, the two-part luminescent material intermixes and luminesces.

From the foregoing, it can be seen that the present invention provides a container for a potable liquid having a self-contained cooling mechanism and/or a selectively illuminated trademark mechanism. Having described my invention, however, many modifications thereto will become apparent to those skilled in the art to which it pertains without deviation from the spirit of the invention as defined by the scope of the appended claims.

I claim:

1. A container assembly comprising:

a container having an elongated cavity open at one end said cavity having internal threads; and a cartridge selectively insertable into and detachably connected to said elongated cavity of said container, said cartridge having a closed internal chamber with an internal frangible membrane dividing said internal chamber cartridge into two sub-chambers each of which containing a liquid which, when intermixed, results in an endothermic reaction said cartridge having external threads which selectively and detachably threadably engage said internal threads of said cavity.

* * * * *